United States Patent [19]

Hirsch

[11] 4,195,247

[45] Mar. 25, 1980

[54] X-RAY TARGET WITH SUBSTRATE OF MOLYBDENUM ALLOY

[75] Inventor: Harold H. Hirsch, Schenectady, N.Y.

[73] Assignee: General Electric Company, Schenectady, N.Y.

[21] Appl. No.: 927,290

[22] Filed: Jul. 24, 1978

[51] Int. Cl.[2] ..... H01J 35/08

[52] U.S. Cl. ..... 313/330; 252/512; 252/513; 252/516; 252/518; 313/311

[58] Field of Search ..... 313/330, 311; 252/512, 252/513

[56] References Cited

U.S. PATENT DOCUMENTS

| | | | |
|---|---|---|---|
| 3,184,834 | 5/1965 | Bechtold | 252/512 X |
| 3,649,355 | 3/1972 | Hennig | 313/330 X |
| 3,660,053 | 5/1972 | Palme | 313/330 X |
| 3,689,795 | 9/1972 | Benesovsky | 313/330 |
| 3,697,798 | 10/1972 | Machenschalk et al. | 313/330 |
| 3,836,808 | 9/1974 | Friedel et al. | 313/330 |
| 3,869,634 | 3/1975 | Konieczynski et al. | 313/330 X |
| 4,000,434 | 12/1976 | Schreiner et al. | 313/330 |
| 4,004,174 | 1/1977 | Yashiro | 313/330 |
| 4,090,103 | 5/1978 | Machenschalk et al. | 313/330 |

*Primary Examiner*—Alfred E. Smith
*Assistant Examiner*—Charles F. Roberts
*Attorney, Agent, or Firm*—Leo I. MaLossi; James C. Davis, Jr.

[57] ABSTRACT

Rotary targets for X-ray tubes are provided comprising a molybdenum base body alloyed with a stabilizing proportion of iron, silicon, cobalt, tantalum, niobium, hafnium, stable metal oxide, or a mixture of the preceding.

9 Claims, 1 Drawing Figure

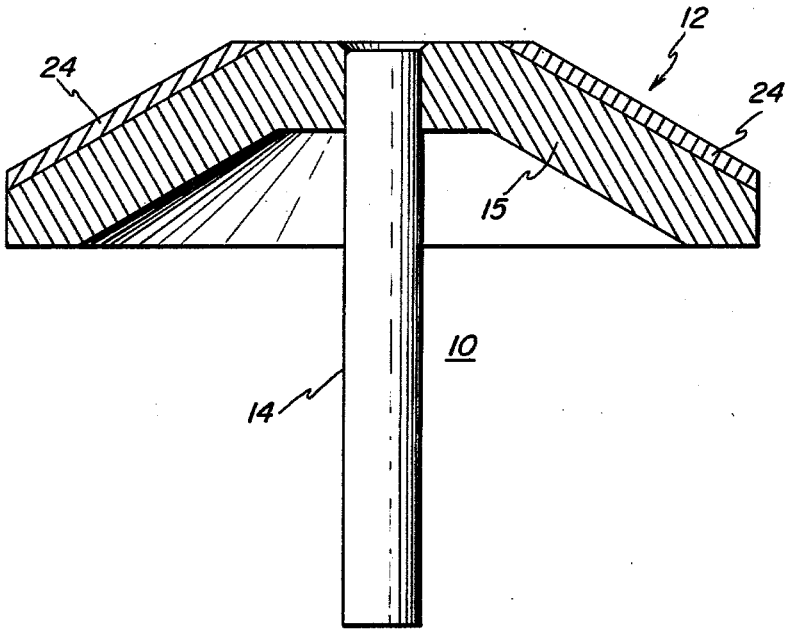
12
24
24
15
10
14

X-RAY TARGET WITH SUBSTRATE OF MOLYBDENUM ALLOY

BACKGROUND OF THE INVENTION

One of the principal problems found with medical X-ray targets is one of warpage of the focal track. While some slight warpage, whether of the concave or convex type, can be tolerated, less than can be detected with the naked eye causes an undesirable drop-off in X-ray output. With warpage of the focal track, X-rays are cut off at the periphery of the X-ray window in the surrounding tube enclosure. As detected by the center position of the X-rays on the external film, if this spot shifts as little as 1°, an X-ray deficiency can exist. With certain target designs and exposures, this can occur in less than 1,000 exposures whereas the X-ray tubes are typically guaranteed for 10,000 exposures. This warpage becomes more severe or occurs earlier as the target diameter increases and the overall temperature of the substrate rises. It is this problem to which this invention is directed and it has been found that this warpage can be minimized by providing certain alloys of molybdenum as the substrate.

British Pat. No. 1,121,407 issued July 24, 1968 and assigned to Metallwerk Plansee Aktiengesellschaft discloses the use of an X-ray base comprising molybdenum alloyed with titanium and/or zirconium and optionally carbon. Other patents such as U.S. Pat. No. 3,649,355 Hennig issued March, 1972 and assigned to Schwarzkopf Development Corporation disclose use of a graphite base, U.S. Pat. No. 3,660,053 Palme issued May 2, 1972 discloses use of a molybdenum base and a commercial X-ray tube is marketed with a base of molybdenum alloyed with 5% tungsten.

SUMMARY OF THE INVENTION

In accordance with this invention, there are provided rotary targets for X-ray tubes which have improved resistance to warpage and which comprise a molybdenum base body alloyed with a stabilizing proportion of iron, silicon, cobalt, tantalum, niobium, hafnium, stable metal oxide or mixture of the preceding.

BRIEF DESCRIPTION OF THE DRAWING

The drawing is an elevation view, in cross-section, of a disk assembly.

DETAILED DESCRIPTION OF THE INVENTION

Referring now to the drawing, there is shown an anode assembly 10 suitable for use in a rotating X-ray anode tube. The anode assembly 10 includes a disk 12 joined to a stem 14 by suitable means such, for example, as by diffusion bonding, welding, mechanical joinder and the like. The disk 12 comprises a molybdenum substrate 15 which is alloyed with a stablizing proportion of iron, silicon, cobalt, tantalum, niobium, hafnium, stable metal oxide or mixture of the preceding. What is meant by stable is that the metal oxides do not decompose, volatilize or grow in particle size to any appreciable extent in the sintering and other heat treatments to form the rotary target and during its service and less than that which results in warpage beyond tolerable limits. Exemplary of suitable stable metal oxides are thorium oxide, zirconium oxide, titanium dioxide, aluminum oxide, magnesium oxide, silicon dioxide, yttrium oxide, cerium oxide and the rare earth metal oxides such as $La_2O_3$, $Nd_2O_3$, and $Pr_6O_{11}$. A stabilizing proportion of the alloying material or materials is enough sufficient to inhibit or reduce warpage of the focal track. The amount will depend on the materials employed, but generally from about 0.05% to about 10% is sufficient.

An anode target 24 is affixed to a selected surface area of the substrate 15. The material of the anode target 24 can be any suitable material such as tungsten or an alloy of tungsten and rhenium. The rhenium content can vary from about 1 up to about 25 weight percent but is typically from 3 to 10 weight percent.

Exemplary of suitable mixtures which can be employed are from 0.5 to 10% and preferably from 1.25 percent to 2.25 percent of tantalum, niobium, or hafnium with from 0.5 to 5% and preferably from 1% to 2% of yttrium oxide, or from 0.05 to 0.3% and preferably from 0.08% to 0.13% of cobalt or silicon with the aforementioned amounts of yttrium oxide or from 0.05 to 0.3% and preferably from 0.08% to 0.13 weight percent of iron with the aforementioned amounts of yttrium oxide.

In a preferred embodiment, an additional material is alloyed into the molybdenum base such as carbides of tantalum or hafnium. An amount of between 0.1 to 5% by weight of the molybdenum is sufficient.

Although the various materials alloyed with the molybdenum can have a wide particle range such as, for example, from 0.01 microns to 30 microns, it is preferred that the average particle size range be between about 0.1 and about 10 microns and that the materials be milled and preferably dry milled so as to limit agglomeration.

The following examples will serve to illustrate the invention. All parts and percentages in said examples, and elsewhere in the specification and claims, and by weight unless otherwise indicated.

EXAMPLES

Rotary X-ray targets comprising a focal track of tungsten alloyed with 5% rhenium and a molybdenum base body alloyed with a metal as reported in the following table, were prepared by the following general method in which the rotary target base body was composed of molybdenum alloyed with 1% of yttrium oxide.

A sample of 986 grams of molybdenum was blended with 9.85 grams of yttrium oxide, or a decomposable yttrium salt, such as yttrium oxalate, acetate, or nitrate, for one hour in a Patterson-Kelly twin shell blender. The mixture was then removed and dry milled in a 1 quart carbide mill for three hours. Although the ingredients can be wet milled, the mixture is preferably dry milled.

Alternatively, the alloys can be prepared by the solution method in which, such as for example, 24.9 grams of yttrium acetate dissolved in deionized water was blended with 908 grams of molybdenum. More water was added if necessary to completely cover the molybdenum and then the mixture slowly evaporated to dryness on a hotplate while constantly kneading to avoid pockets of yttrium acetate salt crystals as it precipitated out of the saturated water solution. Two pounds of the above mixture was then ball milled dry in a 1 quart carbide mill for three hours. This procedure results in a finely divided oxide phase uniformally distributed in the molybdenum matrix. Iron and cobalt is desirably added as a decomposible, reducible salt in a manner similar to the yttrium salts although the powder metal can be employed. Hafnium is desirably added as a hydride powder.

X-ray rotary targets were prepared by heating the powder to decompose and reduce it and then the tungsten-rhenium focal track layer was placed in a compacting die, the mixture leveled and one of the invention base layers placed on top of the focal track layer. The base layer was then leveled and the composite pressed and sintered.

Representative examples of the invention were tested by measuring the warpage after being subjected to 52 Ciné exposures, namely 200 mA at 100 kVp for 8 seconds every 3 minutes. This is a severe exposure that will produce excessive warpage in all targets tested up to this time. In the following Table I, four compositions of the invention are compared with two commercial compositions 5 and 6. Example 1 is seen to be more than 10 times better than commercial composition 5 and all of examples 1 through 3 are seen to be at least five times better than commerical composition 6. Example 4 of the invention is seen to be at least twice as good as either of the commercial compositions with respect to warpage.

TABLE I

WARP TESTS ON MOLYBDENUM ALLOY SUBSTRATE 11° WING TYPE TARGETS

| TUBE EXT. NO. | TARGET SUBSTRATE | *52 CINÉ WARP TEST DEGREES |
|---|---|---|
| 1 | .125% Co/Mo | -0.30° |
| 2 | .125% Co/Mo | -0.45° |
| 3 | 1.0% $Y_2O_3$/Mo | -0.48° |
| 4 | 1.25% Ta/Mo | -1.25° |
| 5 | 100% Mo | -3.1° to 3.5° |
| 6 | 5% W/Mo | -2.6° |

*10,000 rpm. 100 KVP-200 mA-8 second exposures, one exp. every 3 minutes

To demonstrate the effectiveness of other alloys, tensile tests were conducted on rods formed from the alloys. The alloys were prepared by mixing the alloying elements (listed in Table II) with molybdenum, pressing and sintering rods from the powders and then hot swaging to densify. The rods, barbell in shape with a 0.1" diameter in the middle, were annealed at 1650° C. for ½ hour and then pulled in tension in vacuum at 1100° C. employing an Instron tension tester. The yield strength, ultimate strength, total elongation and average reduction in area of the diameter are shown in Table II for the alloys of the invention and for the prior art unalloyed molybdenum, and molybdenum alloyed with 5% tungsten. A minimum of two rods were tested of each composition and the tensile results averaged.

TABLE II

Tensile Data on Bars at 1100° C.

| Composition | 0.2% Y.S.-ksi | U.T.S. ksi | % Total Elong. | Percent Reduction in area |
|---|---|---|---|---|
| Unalloyed Mo | 5-7 | 9-12 | 33 | 85 |
| 1¼% Ta | 8.7 | 18 | 45 | 70 |

TABLE II-continued

Tensile Data on Bars at 1100° C.

| Composition | 0.2% Y.S.-ksi | U.T.S. ksi | % Total Elong. | Percent Reduction in area |
|---|---|---|---|---|
| 2¼% Ta | 10 | 19 | 28 | 80 |
| 1% $Y_2O_3$ | 7.6 | 14 | 45 | 88 |
| 0.125% Co | 14 | 26 | 69 | 77 |
| 0.125% Fe | 11 | 19 | 43 | 90 |
| 0.25% Fe | 14.5 | 25 | 60 | 85 |
| 0.1% Si | 15.5 | 25 | 55 | 85 |
| 0.9% Hf | 10 | 20 | 10 & 24 | 35 & 40 |
| 5% W | 5.7 | 13.5 | 45 | 90 |
| ½% $Y_2O_3$ | 7 | 13.5 | 50 | 85 |
| 0.55% MgO | 6-6.7 | 12-13.8 | 25-35 | 85 |
| 1% HfC | 41 | 48 | 8.8 | 55 |
| *0.085% Fe + 1% $Y_2O_3$ | 9.8 | 12.8 | 37 | 77 |

*tested at 1350° C.

From an examination of the data reported in Table II, it can be seen that the compositions of the invention have both improved yield strength and ultimate tensile strength over the prior art compositions.

What I claim as new and desire to secure by Letters Patent of the United States is:

1. In a rotating X-ray target comprising a molybdenum-containing body and a tungsten-containing focal track supported thereon, the improvement wherein the molybdenum-containing body comprises molybdenum alloyed with at least one additive from the group consisting of iron, silicon cobalt, hafnium carbide, thorium oxide, zirconium oxide, titanium dioxide, aluminum oxide, magnesium oxide, silicon dioxide, yttrium oxide, and the rare earth metal oxides, wherein the content of molybdenum is at least about 90 percent by weight and the amounts of iron, silicon, cobalt or hafnium carbide, when present, fall in the following ranges:

iron—0.05 to 0.3 percent by weight,
silicon—0.05 to 0.3 percent by weight,
cobalt—0.05 to 0.3 percent by weight,
hafnium carbide—0.1 to 5 percent by weight of the molybdenum content, the total additive content being in the range of from about 0.05 percent to about 10 percent by weight.

2. The improvement in rotary targets of claim 1 wherein the molybdenum is alloyed with silicon.

3. The improvement in rotary targets of claim 1 wherein the additive includes from 0.5% to 5% of yttrium oxide.

4. The improvement in rotary targets of claim 1 wherein the additive includes from about 1% to about 2% yttrium oxide.

5. The improvement in rotary targets of claim 1 wherein the additive includes from about 0.08% to about 0.13% of cobalt.

6. The improvement in rotary targets of claim 1 wherein the additive includes from 0.05 to 0.3% iron and from 0.5 to 5% yttrium oxide.

7. The improvement in rotary targets of claim 6 wherein the additive includes about 0.085% iron about 0.085% iron and about 1% yttrium oxide.

8. The improvement in rotary targets of claim 1 wherein the tungsten-containing track is tungsten alloyed with rhenium.

9. The improvements in rotating targets of claim 8 wherein from 0.5% to 35% by weight rhenium is present in the tungsten alloy.

* * * * *